US011434031B1

(12) United States Patent
Benes

(10) Patent No.: US 11,434,031 B1
(45) Date of Patent: Sep. 6, 2022

(54) CAN GUIDE SYSTEM FOR A CAN CARRIER APPLICATOR APPARATUS

(71) Applicant: David J. Benes, Elkhorn, NE (US)

(72) Inventor: David J. Benes, Elkhorn, NE (US)

( * ) Notice: Subject to any disclaimer, the term of this patent is extended or adjusted under 35 U.S.C. 154(b) by 96 days.

(21) Appl. No.: 16/868,810

(22) Filed: May 7, 2020

(51) Int. Cl.
*B65B 17/02* (2006.01)
*B65B 35/30* (2006.01)

(52) U.S. Cl.
CPC ..... *B65B 35/30* (2013.01); *B65B 17/025* (2013.01)

(58) Field of Classification Search
USPC ..... 53/48.1
See application file for complete search history.

(56) References Cited

U.S. PATENT DOCUMENTS

| | | | | |
|---|---|---|---|---|
| 5,383,321 | A * | 1/1995 | Krogman | B65B 17/025 53/48.4 |
| 7,377,382 | B2 | 5/2008 | Borg et al. | |
| 7,588,275 | B2 | 9/2009 | Borg | |
| 10,457,430 | B2 | 10/2019 | Daniel et al. | |
| 2019/0092503 | A1* | 3/2019 | Daniel | B65B 17/025 |

* cited by examiner

*Primary Examiner* — Chinyere J Rushing-Tucker
(74) *Attorney, Agent, or Firm* — Suiter Swantz pc llo

(57) ABSTRACT

A can guide system for a can carrier applicator apparatus with the applicator having a can passageway formed therein which is defined by vertically disposed first and second support walls. A first can guide is mounted on the inner side of the first support wall and a second can guide is mounted on the inner side of the second support wall. Each of the can guides are movably mounted in a recess in the inner side of the respective support wall. Each of the can guides have a can stop formed on the forward ends thereof. Each of the can guides are pivotally movable between first and second positions. When in the first position, the can stops prevent cans from passing thereby. When in the second position, the can stops are not in the paths of the cans passing through the can passageway.

3 Claims, 8 Drawing Sheets

CAN GUIDE SYSTEM FOR A CAN CARRIER APPLICATOR APPARATUS

BACKGROUND OF THE INVENTION

Field of the Invention

This Invention relates to a can guide system and more particularly to a can guide system for a can carrier applicator machine or apparatus. Even more particularly, this invention relates to a can guide system which includes horizontally spaced-apart and spring-loaded can guides which are positioned at the sides of a can passageway in a can carrier applicator machine.

Description of the Related Art

Container or can carriers such as described in U.S. Pat. No. 7,588,275 are applied to containers such as cans to provide a convenient way for a person to carry either two cans, four cans or six cans by the handles thereof. The can carriers are applied to the upper ends of the cans as the cans are moved through the prior art can carrier applicator machines. To the best of Applicant's knowledge, the prior art can carrier applicator machines have difficulty in properly sequentially positioning the cans in double rows of the cans as the carrier is being applied to the cans.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A can guide system is provided for use with a can carrier applicator machine or apparatus. The can carrier applicator apparatus includes a can passageway which is defined by horizontally spaced-apart and vertically disposed first and second support walls with the can passageway having a forward can inlet and rearward can outlet end. Each of the first and second support walls have a guide recess formed therein. Each of the can guides includes a vertically disposed and rectangular plate portion having an upper end, a lower end, a rearward end, a forward end, an outer side and an inner side. Each of the rectangular plate portions of the can guides have a can stop at the forward ends thereof. Each of the can guides are movable between first and second positions. When the can guides are in the first position, the can stops thereof are positioned in the can passageway to prevent cans from passing thereby. Each of the can guides is spring-loaded to yieldably urge the can stops into the can passageway. When sufficient force is applied to the can stops, the can stops will be withdrawn from the can passageway to permit cans to pass thereby.

It is therefore a principal object of the invention to provide an improved can guide system for a can carrier applicator apparatus.

A further object of the invention is to provide a can guide system for a can carrier applicator apparatus which includes spring-loaded can stops, which are movable between first and second positions, and which extend into the can passageway of the apparatus to prevent cans from passing thereby.

A further object of the invention is to provide a can guide system including spring-loaded can guide stops.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
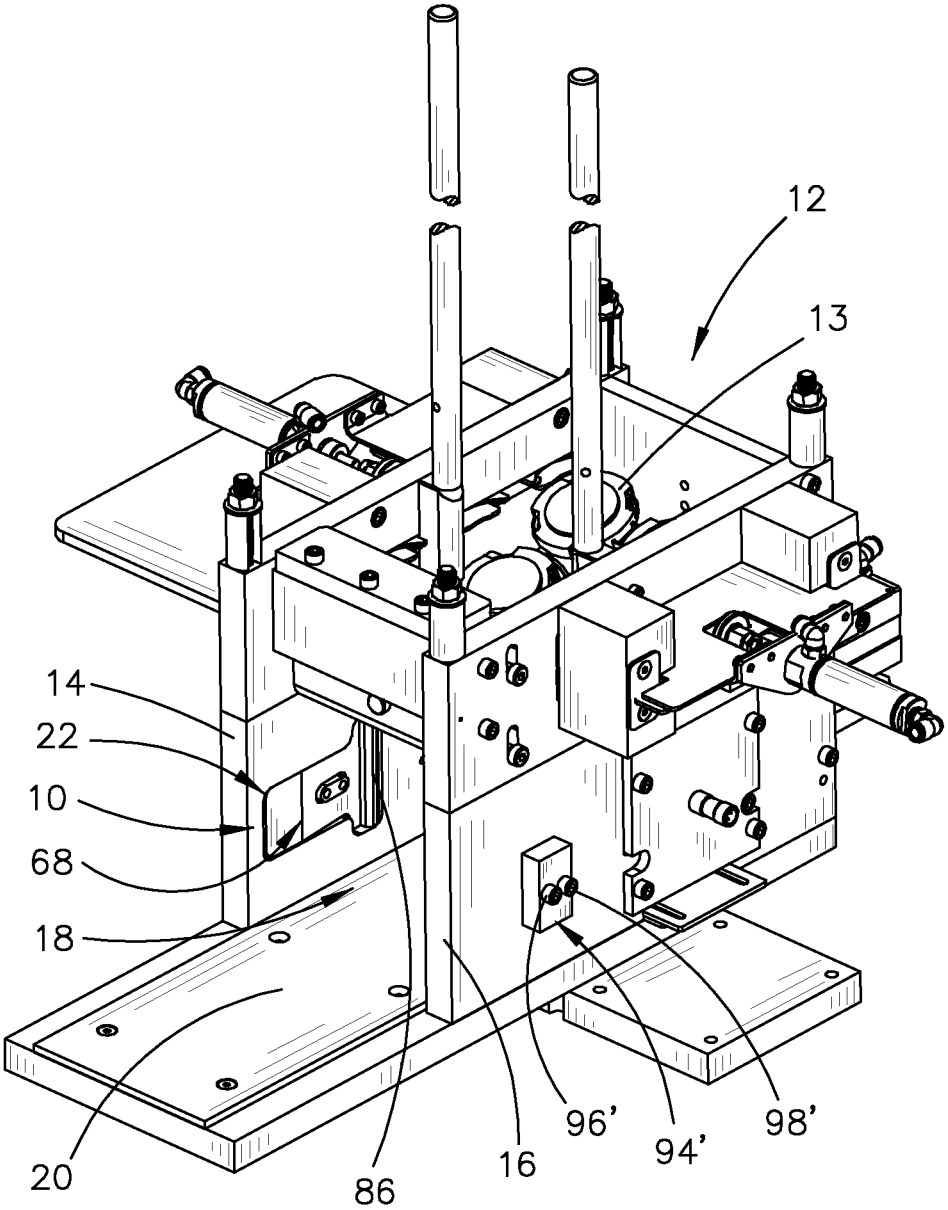
FIG. 1 is a partial perspective view of a can carrier applicator apparatus having the can guide system of this invention incorporated into the applicator apparatus.
Figure 2:
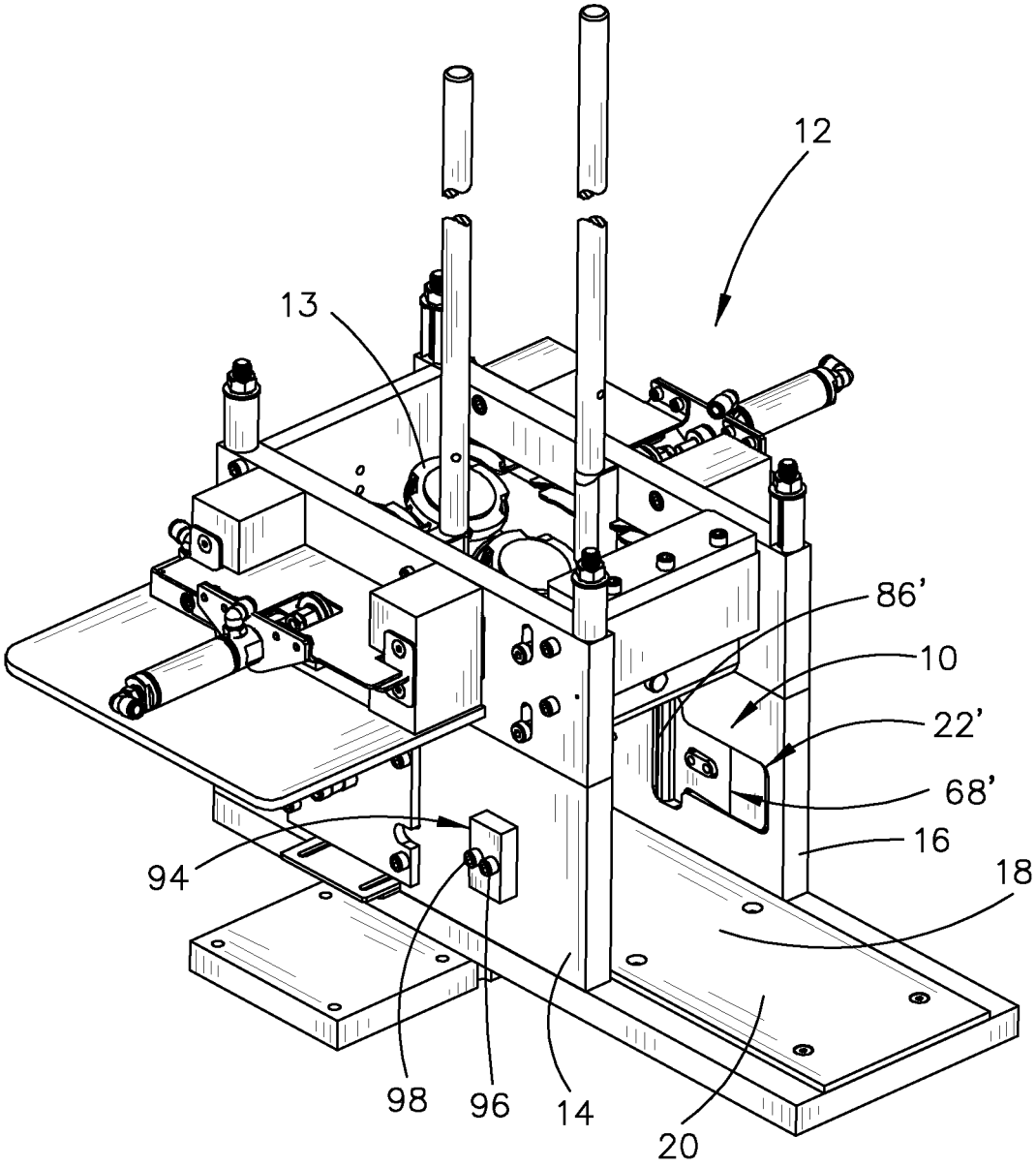
FIG. 2 is another partial perspective view of the can carrier applicator apparatus of FIG. 1 having the can guide system of this invention incorporated into the applicator apparatus.
Figure 3:
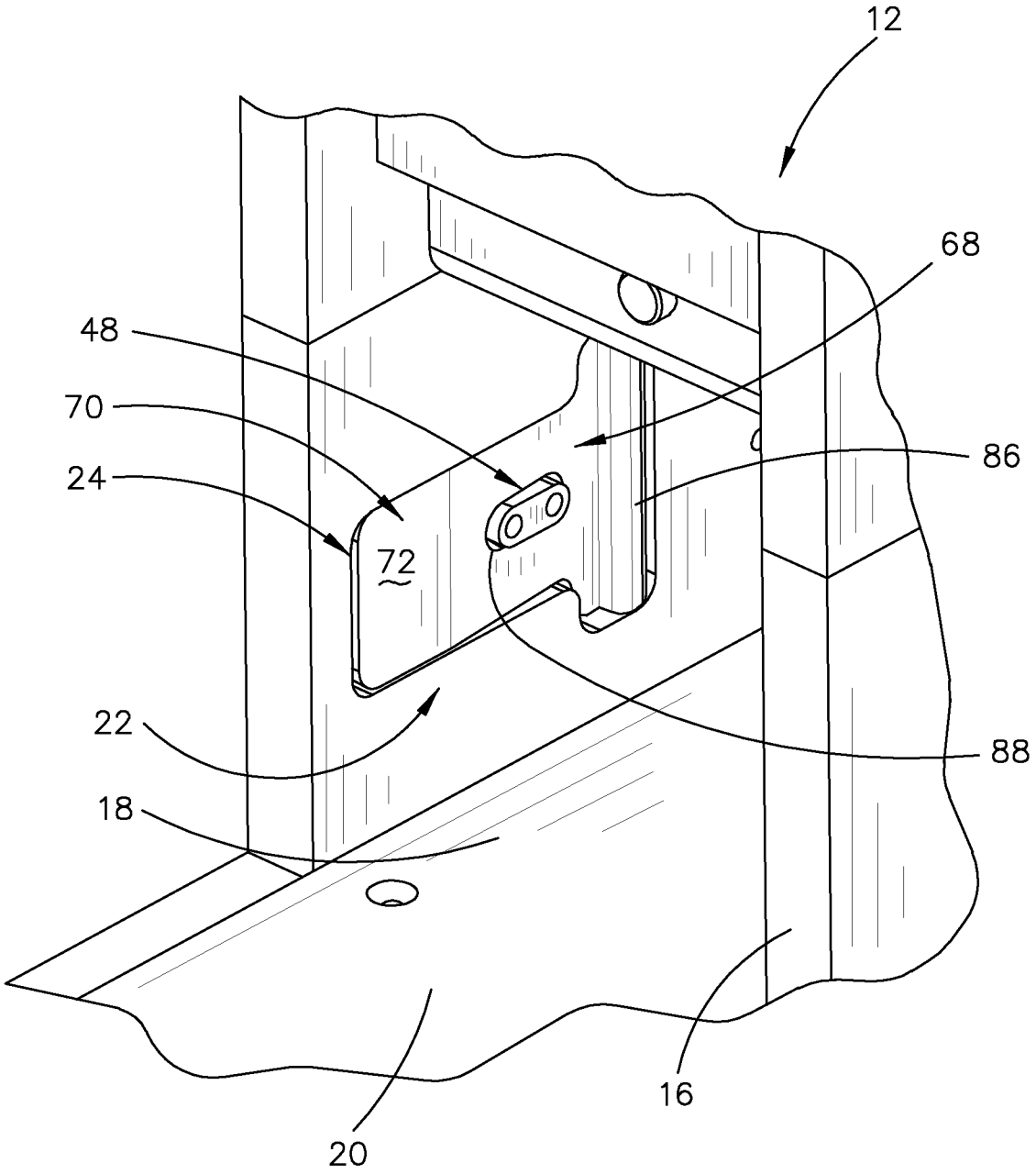
FIG. 3 is a partial perspective view illustrating one of the can guides of this invention mounted in the first support wall of the applicator apparatus.
Figure 4A:
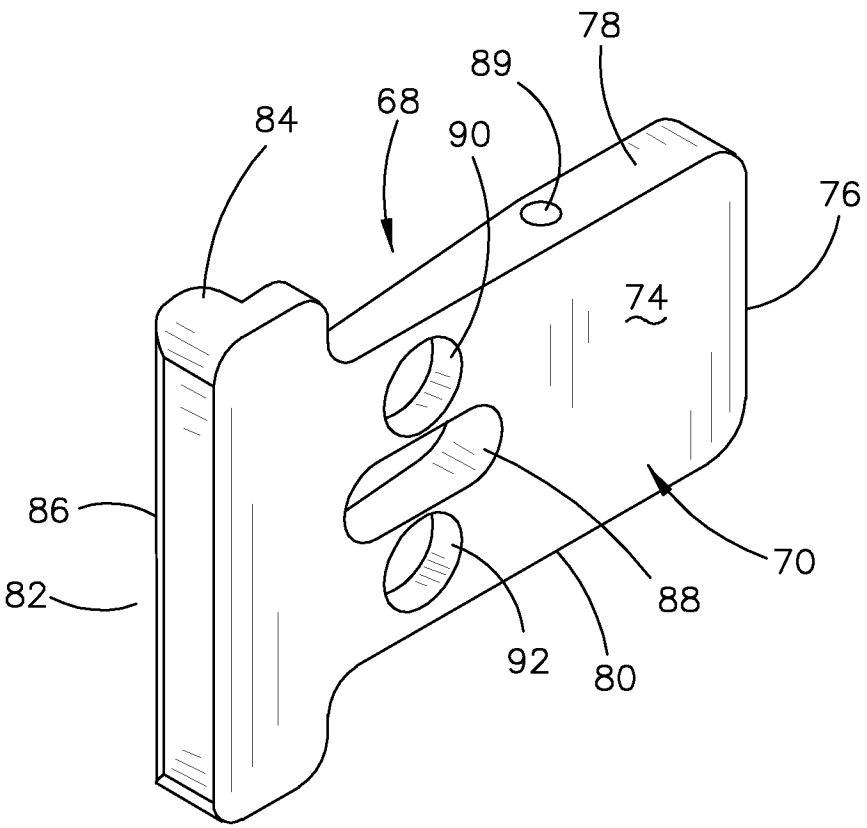
FIG. 4A is a perspective view of the first can guide of this invention which is viewed from the outer forward side thereof.
Figure 4:
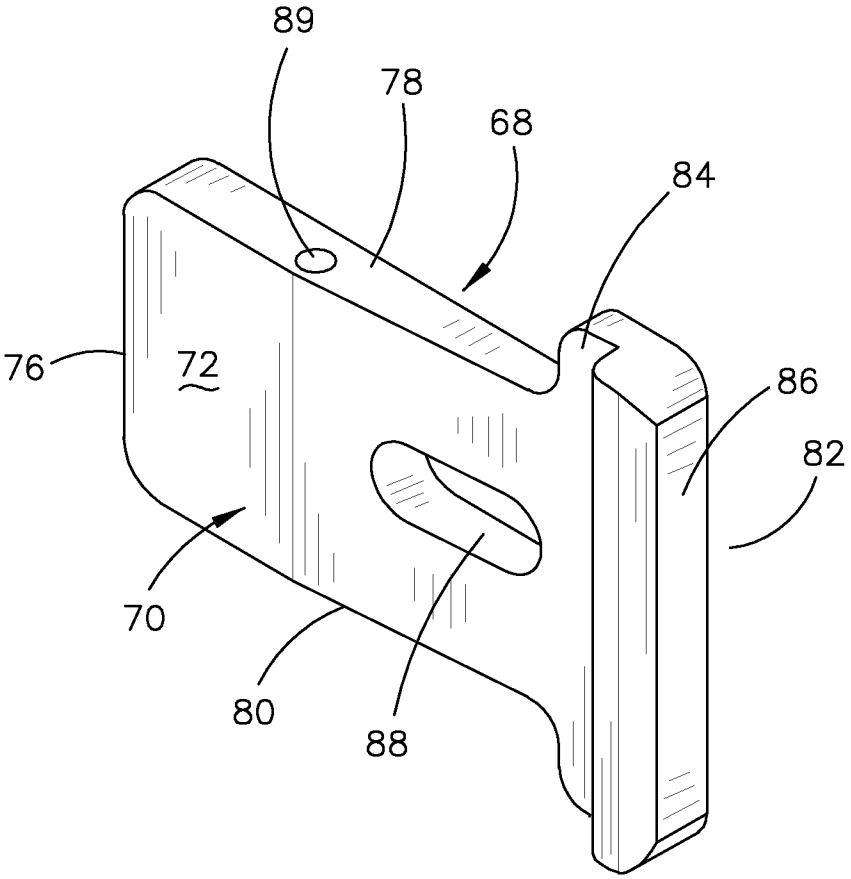
FIG. 4 is a perspective view of the first can guide of this invention which is mounted in the first side wall of the can carrier applicator apparatus as viewed from the inner forward side thereof.
Figure 5A:
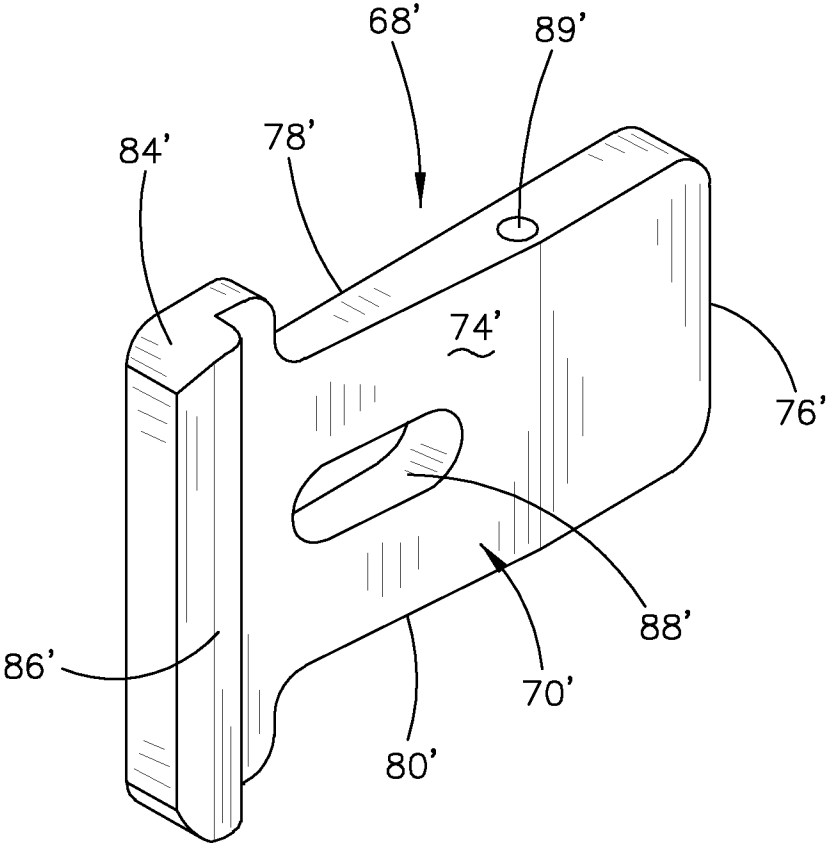
FIG. 5A is an inner perspective view of the can guide of FIG. 5.
Figure 5:
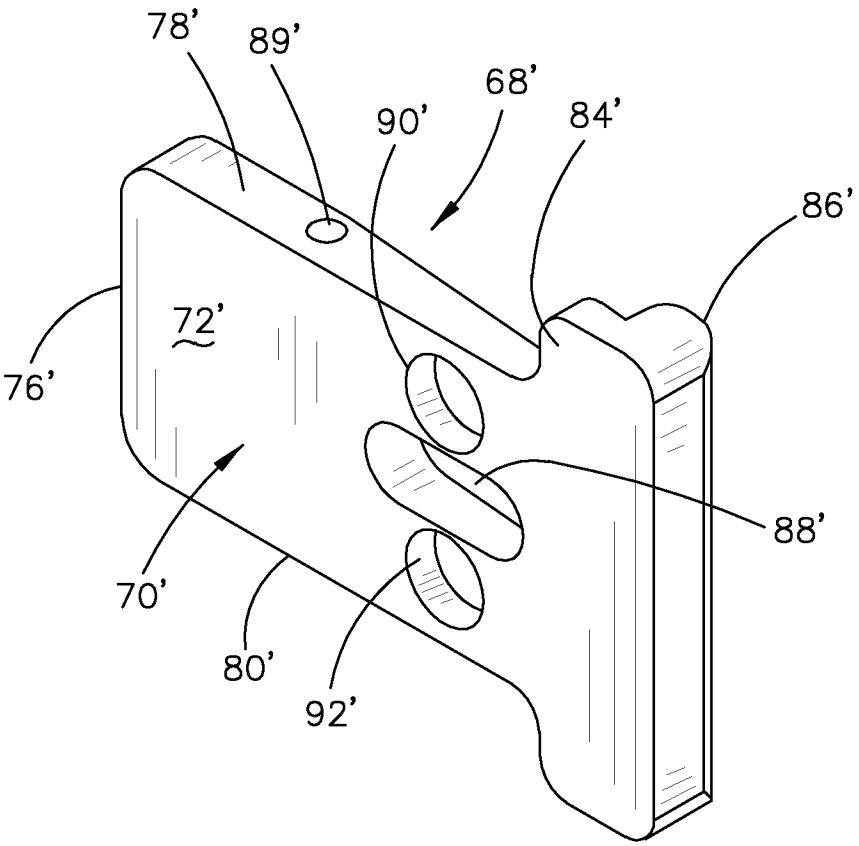
FIG. 5 is a perspective view of the can guide of this invention which is mounted in the second support wall of the can carrier applicator apparatus.
Figure 6:
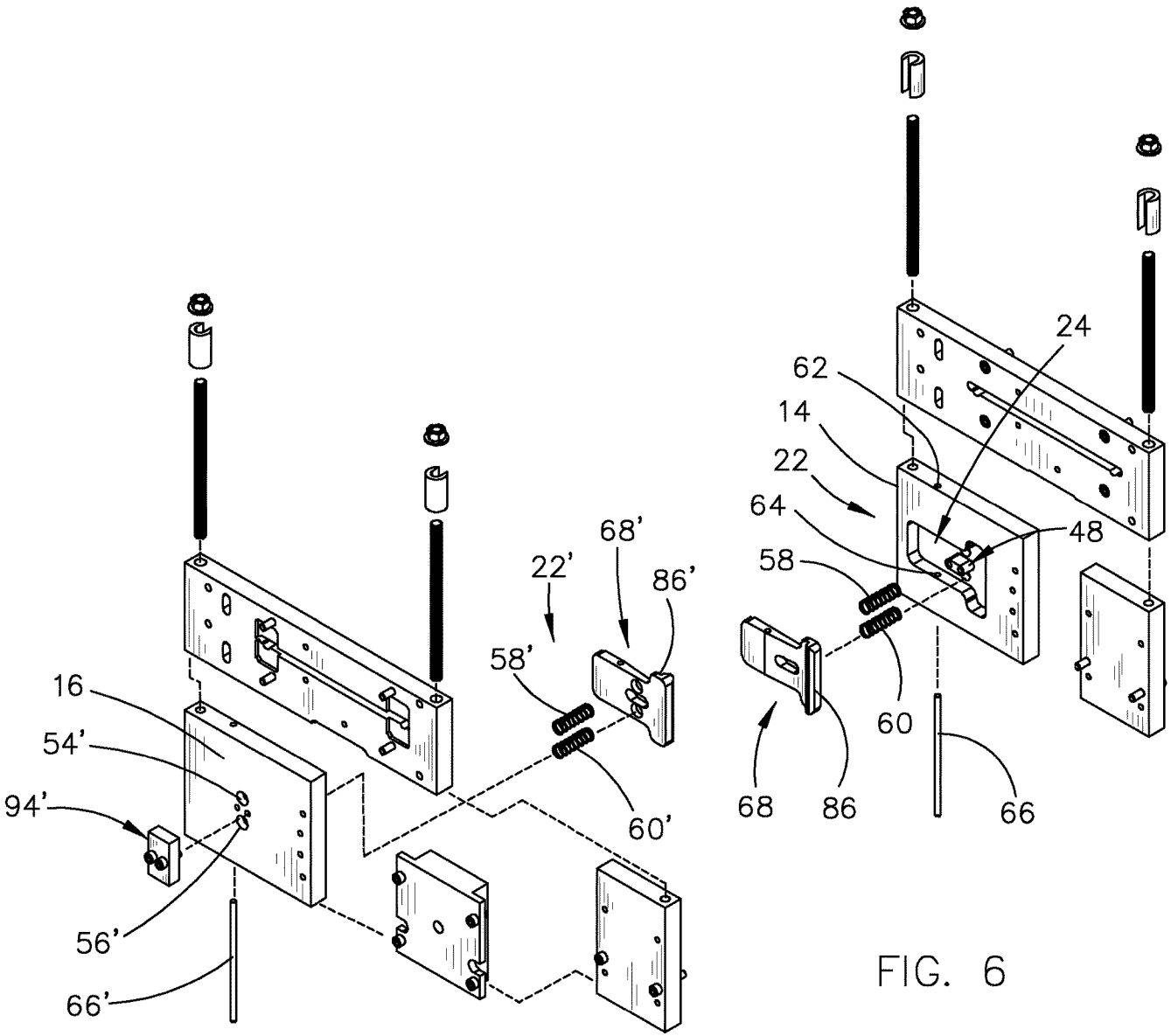
FIG. 6 is a partial exploded perspective view of the can guide system of this invention and a portion of the can carrier applicator apparatus of FIGS. 1 and 2.
Figure 7:
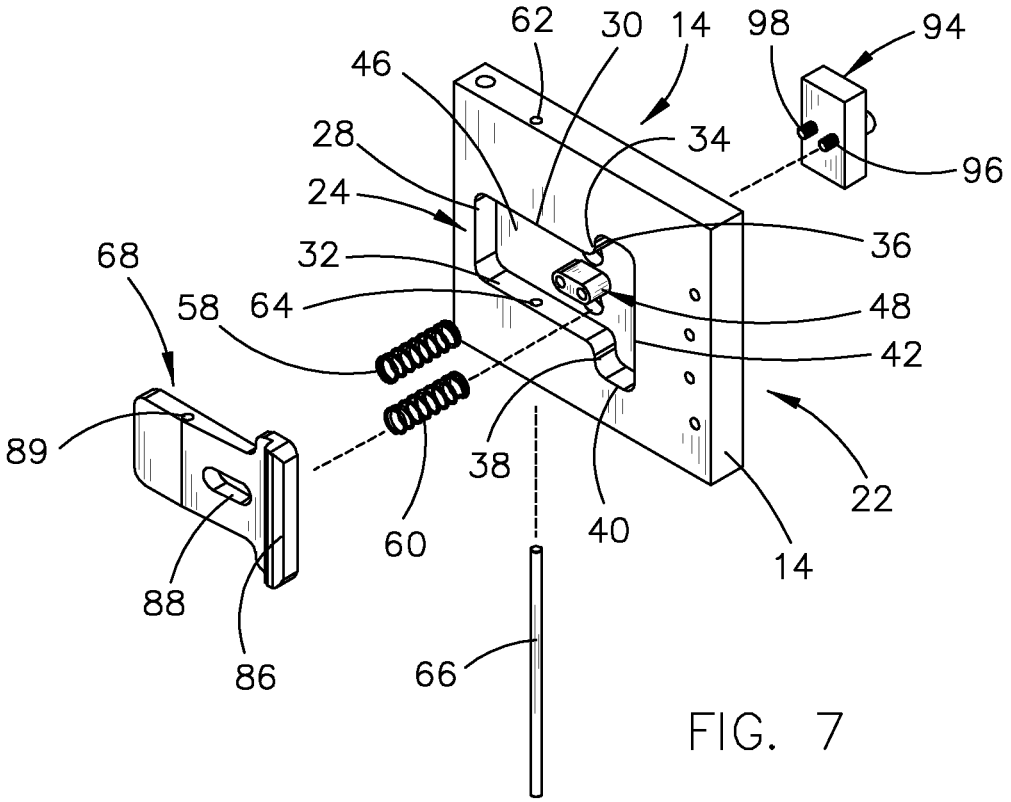
FIG. 7 is a partial exploded perspective view of the first can guide assembly of this invention and the first support wall of the can carrier applicator apparatus.
Figure 8:
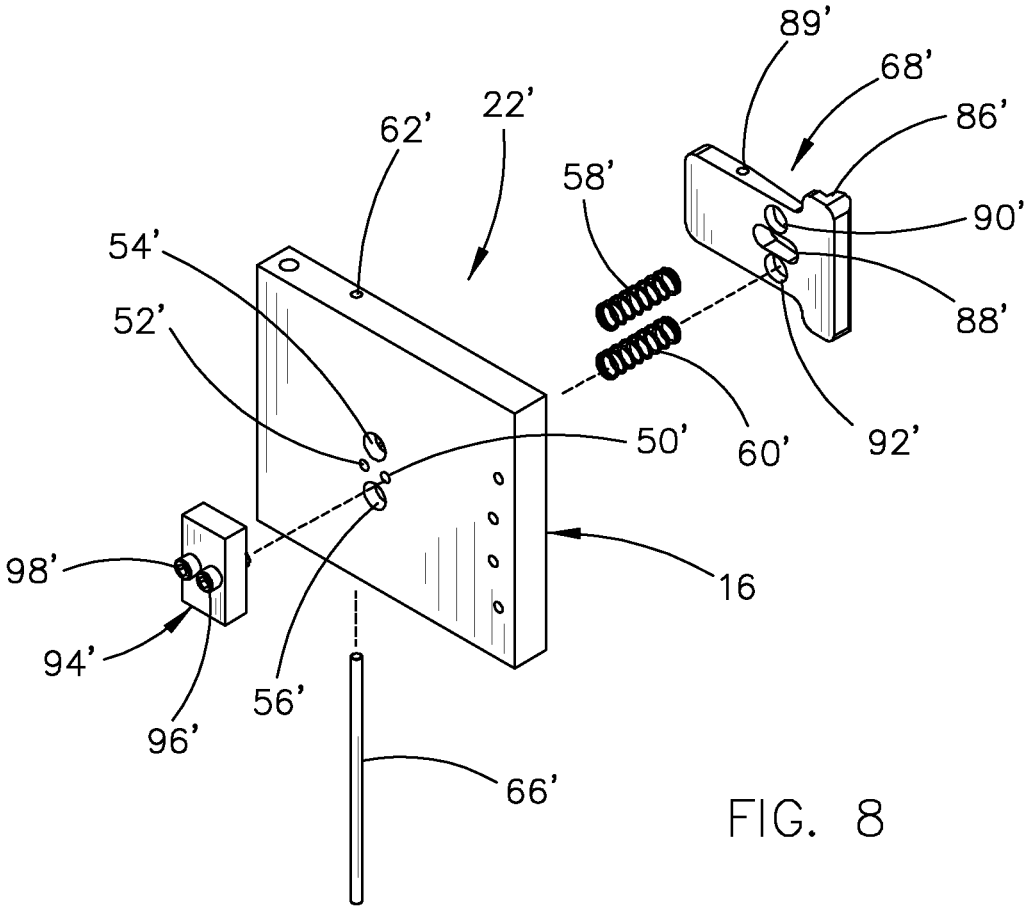
FIG. 8 is a partial exploded perspective view of the second can guide assembly of this invention and the second support wall of the can carrier applicator apparatus.
Figure 9:
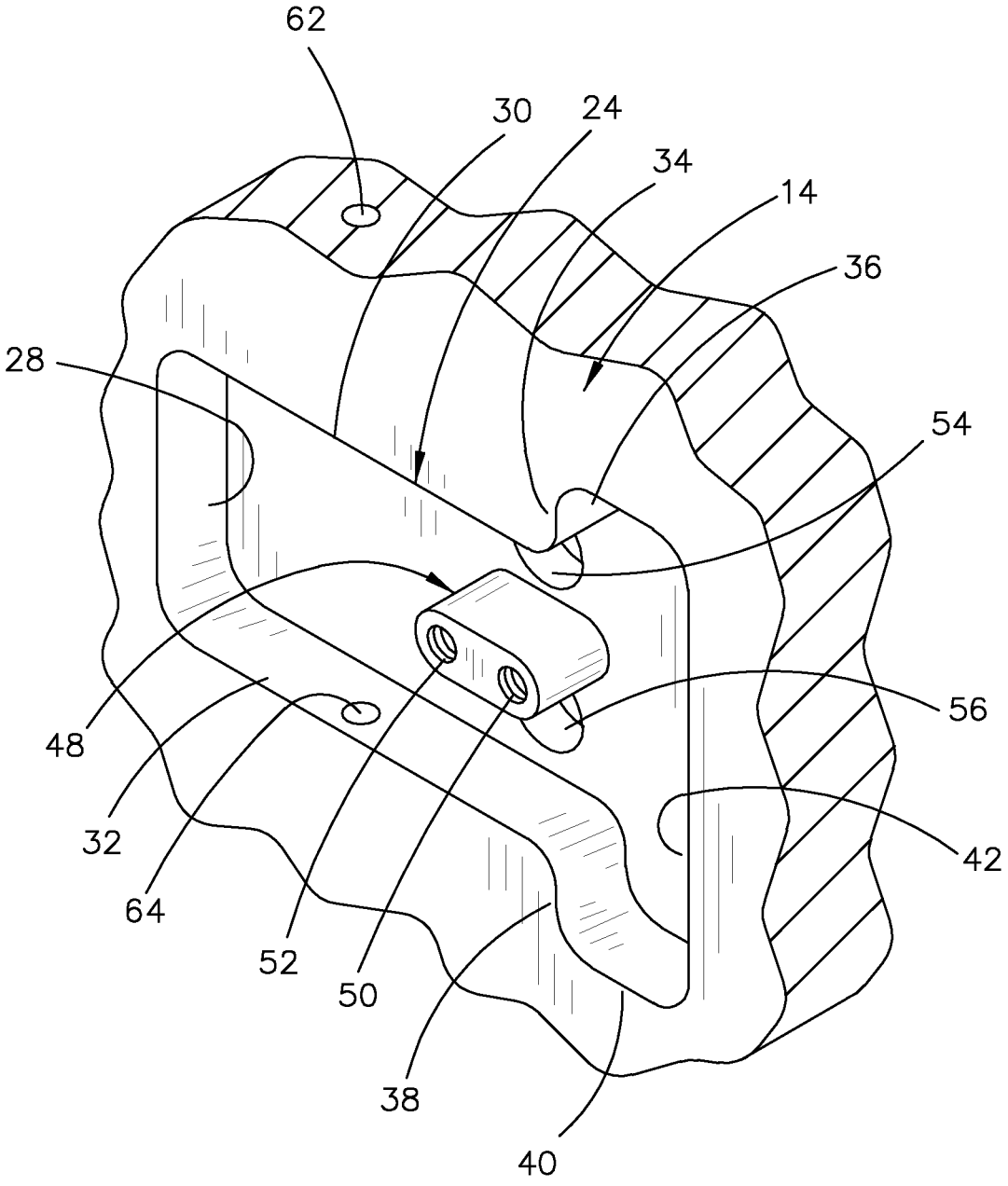
FIG. 9 is a partial inner perspective view of the first support wall of the can carrier applicator apparatus which illustrates the first guide recess formed therein into which the first guide is inserted.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The can guide system of this invention is referred to by the reference numeral 10. Can guide system 10 is designed to be used with a can carrier applicator apparatus or machine 12 such as manufactured by Fremont Automation, Inc. of Fremont, Nebr. The machine 12 is designed to apply plastic can carriers 13 onto the tops of cans which may be 2 cans, 4 cans or 6 cans. Machine 12 includes a first vertically disposed first support wall 14 and a second support wall 16. The support walls 14 and 16 define a can passageway 18 therebetween which has a can outlet end 20.

Can guide system 10 is comprised of a can guide assembly 22 associated with the first support wall 14 and a can guide assembly 22' associated with the second support 16. Can guide assembly 22' is a mirror image of can guide assembly 22 and will not be described in detail with "'" indicating structure of can guide assembly 22' which is identical to the structure of can guide assembly 22.

Can guide assembly 22 will now be described. A first guide recess 24 is formed in the inner side 26 of support wall 14. Guide recess 24 includes a vertical disposed first recess portion 28 having upper and lower ends. A horizontally disposed second recess portion 30, having forward and rearward ends, extends horizontally forwardly from the upper end of first recess portion 28. A horizontally disposed third recess portion 32, having forward and rearward ends, extends forwardly from the lower end of the first recess portion 28. A vertically disposed fourth recess portion 34, having upper and lower ends, extends upwardly from the forward end of the second recess portion 30. A horizontally disposed fifth recess portion 36, having forward ends and rearward ends, extends forwardly from the upper end of the fourth recess portion 34. A vertically disposed sixth recess portion 38, having upper and lower ends, extends downwardly from the forward end of recess portion 32. A horizontally disposed seventh recess portion 40, having forward and rearward ends, extends forwardly from the lower end of the sixth recess portion. A vertically disposed eighth recess portion 42 extends between the forward ends of the fifth recess portion 36 and the seventh recess portion 40.

The recess portions 34, 36, 38 and 42 form a vertically disposed and generally rectangular notch 44. The recess portions 28, 30 and 32 define a vertically disposed inner wall 46. A horizontally disposed support member 48 extends from inner wall 46 and has internally threaded bolt openings 50 and 52 formed therein which extend to the outer side of support wall 14. Support wall 14 also has vertically spaced-apart spring openings 54 and 56 formed therein. Elongated coil springs 58 and 60 are positioned in spring openings 54 and 56 respectively whereby the inner ends thereof are positioned inwardly of inner wall 46 and whereby the outer ends thereof are positioned outwardly of the outer side of support wall 14.

Support wall 14 has a vertically extending pivot pin bore 62 formed therein which extends upwardly from recess portion 30 to the upper end of support wall 14. Support wall 14 also has a vertically extending pivot pin bore 64 formed therein which extends downwardly from recess portion 32. Bores 62 and 64 are configured to receive a pivot pin or rod 66 therein.

Can guide assembly 22 also includes a can guide 68 which has the same general shape as the first guide recess 24. Can guide 68 includes a vertically disposed rectangular plate portion 70 having an outer side 72 and an inner side 74. Plate portion 70 includes a vertically disposed rearward end 76, an upper end 78, a lower end 80 and a forward end 82. Plate portion 70 has a vertically disposed inner end portion 84 which has an elongated can stop 86 extending therefrom. Plate portion 70 has an elongated and horizontally disposed opening 88 formed therein which is configured to receive support member 48 of support wall 14 therein. The inner side 74 of plate portion 70 has spring recesses 90 and 92 formed therein.

As stated above, the inner ends of the coil springs 58 and 60 extend through spring openings 54 and 56 in support wall 14. A spring retainer plate 94 is positioned at the outer side of support wall 14 and has bolts 96 and 98 extending inwardly therethrough. The inner ends of bolts 96 and 98 are threadably received in the internally threaded bolt openings 50 and 52 to secure spring retainer plate 94 on wall 14 so that compressive force is applied to the coil springs 58 and 60 which yieldably urge plate portion 70 into its first position so the can stop 86 is in the path of a can passing rearwardly through the can passageway 18. Can stop 86 remains in its can stopping first position until sufficient force is applied to the can to force the can stop 86 out of the path of the can. As soon as the can moves past the retracted can stop 86, the can guide 68 and the can stop 86 will return to the first position so that the can stop 86 is again in the path of the next can passing through the can passageway 18. The can guide assembly 22' functions in the same manner as can guide assembly 22 and in unison therewith.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

an apparatus for applying a can carrier to the upper ends of a plurality of cans as the cans pass therethrough;

said apparatus including a can passageway which is defined by horizontally spaced-apart and vertically disposed first and second support walls with said can passageway having a forward can inlet end and a rearward can outlet end;

said first support wall having an upper end, a lower end, a rearward end, a forward end, an inner side and an outer side;

said inner side of said first support wall having a first guide recess formed therein which extends partially thereinto;

said first guide recess including:

(a) a vertically disposed first recess portion having an upper end and a lower end;

(b) a horizontally disposed second recess portion, having a rearward end and a forward end, which extends forwardly from said upper end of said first recess portion;

(c) a horizontally disposed third recess portion, having a rearward end and a forward end, which extends forwardly from said lower end of said first recess portion;

(d) a vertically disposed fourth recess portion, having an upper end and a lower end, which extends upwardly from said forward end of said second recess portion;

(e) a horizontally disposed fifth recess portion, having a forward end and a rearward end, which extends forwardly from said upper end of said fourth recess portion;

(f) a vertically disposed sixth recess portion, having an upper end and a lower end, which extends downwardly from said forward end of said third recess portion;

(g) a horizontally disposed seventh recess portion, having a forward end and a rearward end, which extends forwardly from said lower end of said sixth recess portion;

(h) and a vertically disposed eighth recess portion, having upper and lower ends, which extends between said forward ends of said fifth and seventh recess portions;

(i) said fourth, fifth, sixth, seventh and eighth recess portions defining a vertically disposed and generally rectangular-shaped notch having upper and lower ends;

said first guide recess defining a vertically disposed inner wall;

said first support wall, within said first guide recess, having a horizontally disposed support member, having inner and outer ends, extending outwardly from said vertically disposed inner wall of said first guide recess;

said support member having first and second internally threaded bolt openings extending horizontally therethrough;

a vertically disposed first guide positioned in said first guide recess;

said first guide including a vertically disposed and rectangular plate portion having an upper end, a lower end, a rearward end, a forward end, an outer side and an inner side;

said rectangular plate portion of said first guide having a horizontally disposed and elongated first opening formed therein;

said rectangular plate portion of said first guide being positioned in said first guide recess between said first, second and third recess portions thereof;

said horizontally disposed and elongated first opening in said rectangular plate portion of said first guide receiving said support member which extends from said inner wall of said first guide recess;

said first guide having a vertically disposed forward end portion, having inner and outer sides, movably positioned between said fourth, fifth, sixth, seventh and eighth recess portions of said first guide recess;

said vertically disposed forward end portion of said first guide including an elongated and vertically disposed can stop extending outwardly therefrom;

said rectangular plate portion being pivotally secured, about a vertical axis, to said first support wall forwardly of said rearward end of said plate portion of said first guide;

said first guide being pivotally movable, about a vertical axis, between first and second positions with respect to said first support wall and said first guide recess;

said first can stop, when said first guide is in said first position, extending into said can passageway so as to be in the path of a can passing through said can passageway;

said first can stop, when said first guide is in said second position, being retracted into said first guide recess to permit a can to pass thereby;

said first support wall having vertically spaced-apart first and second spring openings, having inner and outer ends, formed therein which extend through said first support wall;

said inner ends of said first and second spring openings in said first support wall communicating with said first guide recess;

an elongated first coil spring having an inner end and an outer end;

an elongated second coil spring, having an inner end and an outer end;

said first and second coil springs being positioned in said first and second spring openings in said first support wall respectively whereby said outer ends of said first and second coil springs are positioned outwardly of said outer side of said first support wall and whereby said inner ends of said first and second coil springs are in engagement with said first guide;

a spring retainer plate positioned at said outer side of said first support wall which is in engagement with said outer ends of said first and second coil springs;

a first bolt extending through said first support wall and which is threadably secured to one of said internally threaded bolt openings in said support member;

a second bolt extending inwardly through said first support wall and which is threadably secured to the other internally threaded bolt openings in said support member;

said second support wall having an upper end, a lower end, a rearward end, a forward end, an inner side and an outer side;

said inner side of said second support wall having a second guide recess formed therein which extends partially thereinto;

said second guide recess of said second support wall including:

(a) a vertically disposed first recess portion having an upper end and a lower end;

(b) a horizontally disposed second recess portion, having a rearward end and a forward end, which extends forwardly from said upper end of said first recess portion;

(c) a horizontally disposed third recess portion, having a rearward end and a forward end, which extends forwardly from said lower end of said first recess portion;

(d) a vertically disposed fourth recess portion, having an upper end and a lower end, which extends upwardly from said forward end of said second recess portion;

(e) a horizontally disposed fifth recess portion, having a forward end and a rearward end, which extends forwardly from said upper end of said fourth recess portion;

(f) a vertically disposed sixth recess portion, having an upper end and a lower end, which extends downwardly from said forward end of said third recess portion;

(g) a horizontally disposed seventh recess portion, having a forward end and a rearward end, which extends forwardly from said lower end of said sixth recess portion;

(h) and a vertically disposed eighth recess portion, having upper and lower ends, which extends between said forward ends of said fifth and seventh recess portions;

(i) said fourth, fifth, sixth, seventh and eighth recess portions defining a vertically disposed and generally rectangular-shaped notch having upper and lower ends;

said second guide recess defining a vertically disposed inner wall;

said second support wall, within said second guide recess thereof, having a horizontally disposed support member, having inner and outer ends, extending outwardly from said vertically disposed inner wall of said second guide recess;

said support member of said second support wall having first and second internally threaded bolt openings extending horizontally therethrough;

a vertically disposed second guide positioned in said second guide recess of said second support wall;

said second guide including a vertically disposed and rectangular plate portion having an upper end, a lower end, a rearward end, a forward end, an outer side and an inner side;

said rectangular plate portion of said second guide having a horizontally disposed and elongated first opening formed therein;

said rectangular plate portion of said second guide being positioned in said second guide recess of said second support wall between said first, second and third recess portions thereof;

said horizontally disposed and elongated first opening in said rectangular plate portion of said second guide receiving said support member which extends outwardly from said inner wall of said second guide recess;

said second guide having a vertically disposed forward end portion, having inner and outer sides, movably positioned between said fourth, fifth, sixth, seventh and eighth recess portions of said second guide recess of said second support wall;

said vertically disposed forward end portion of said second guide including an elongated and vertically disposed can stop extending outwardly therefrom;

said rectangular plate portion of said second guide being pivotally secured, about a vertical axis, to said second support wall forwardly of said rearward end of said rectangular plate portion thereof;

said second guide being pivotally movable, about a vertical axis, between first and second positions with respect to said second support wall and said second guide recess;

said second can stop, when said second guide is in said first position, extending into said can passageway so as to be in the path of a can passing through said can passageway;

said second can stop, when said second guide is in said second position, being retracted into said second guide recess to permit a can to pass thereby;

said second support wall having vertically spaced-apart first and second spring openings, having inner and outer ends, formed therein which extend through said second support wall;

said inner ends of said first and second spring openings in said second support wall communicating with said second guide recess of said second support wall;

an elongated first coil spring having an inner end and an outer end;

an elongated second coil spring, having an inner end and an outer end;

said first and second coil springs being positioned in said first and second spring openings in said second support wall respectively whereby said outer ends of said first and second coil springs are positioned outwardly of said outer side of said second support wall and whereby said inner ends of said first and second coil springs are in engagement with said second guide;

a spring retainer plate positioned at said outer side of said second support wall which is in engagement with said outer ends of said first and second coil springs;

a first bolt extending through said second support wall and which is threadably secured to one of said internally threaded bolt openings in said support member of said second support wall;

a second bolt extending inwardly through said second support wall and which is threadably secured to the other internally threaded bolt opening in said support member of said second support wall.

2. In combination:

an apparatus for applying a can carrier to the upper ends of a plurality of cans as the cans pass therethrough;

said apparatus including a can passageway which is defined by horizontally spaced-apart and vertically disposed first and second support walls with said can passageway having a forward can inlet end and a rearward can outlet end;

said first support wall having an upper end, a lower end, a rearward end, a forward end, an inner side and an outer side;

said inner side of said first support wall having a first guide recess formed therein which extends partially thereinto;

said first guide recess defining a vertically disposed inner wall;

said first support wall, within said first guide recess, having a horizontally disposed support member, having inner and outer ends, extending outwardly from said vertically disposed inner wall of said first guide recess;

said support member having first and second internally threaded bolt openings extending horizontally therethrough;

a vertically disposed first guide positioned in said first guide recess;

said first guide having an upper end, a lower end, a rearward end, a forward end, an outer side and an inner side;

said first guide having a horizontally disposed and elongated first opening formed therein;

said first guide being positioned in said first guide recess;

said horizontally disposed and elongated first opening in said first guide receiving said support member which extends outwardly from said inner wall of said first guide recess;

said first guide having a vertically disposed forward end portion, having inner and outer sides, movably positioned in said first guide recess;

said vertically disposed forward end portion of said first guide including an elongated and vertically disposed can stop extending outwardly therefrom;

said first guide being pivotally secured, about a vertical axis, to said first support wall forwardly of said rearward end of said first guide;

said first guide being pivotally movable, about a vertical axis, between first and second positions with respect to said first support wall and first guide recess;

said first can stop, when said first guide is in said first position, extending into said can passageway so as to be in the path of a can passing through said can passageway;

said first can stop, when said first guide is in said second position, being retracted into said first guide recess to permit a can to pass thereby;

said first support wall having vertically spaced-apart first and second spring openings, having inner and outer ends, formed therein which extend through said first support wall;

said inner ends of said first and second spring openings in said first support wall communicating with said first guide recess;

an elongated first coil spring having an inner end and an outer end;

an elongated second coil spring, having an inner end and an outer end;

said first and second coil springs being positioned in said first and second spring openings in said first support wall respectively whereby said outer ends of said first and second coil springs are positioned outwardly of said outer side of said first support wall and whereby said inner ends of said first and second coil springs are in engagement with said first guide;

a spring retainer plate positioned at said outer side of said first support wall which is in engagement with said outer ends of said first and second coil springs;

a first bolt extending through said first support wall and which is threadably secured to one of said internally threaded bolt openings in said support member;

a second bolt extending inwardly through said first support wall and which is threadably secured to the other internally threaded bolt openings in said support member;

said second support wall having an upper end, a lower end, a rearward end, a forward end, an inner side and an outer side;

said inner side of said second support wall having a second guide recess formed therein which extends partially thereinto;

said second guide recess defining a vertically disposed inner wall;

said second support wall, within said second guide recess thereof, having a horizontally disposed support member, having inner and outer ends, extending outwardly from said vertically disposed inner wall of said second guide recess;

said support member of said second support wall having first and second internally threaded bolt openings extending horizontally therethrough;

a vertically disposed second guide movably positioned in said second guide recess of said second support wall;

said horizontally disposed and elongated first opening in said second guide receiving said support member which extends outwardly from said inner wall of said second guide recess;

said second guide including an elongated and vertically disposed can stop extending outwardly therefrom;

said second guide being pivotally secured, about a vertical axis, to said second support wall forwardly of said rearward end thereof;

said second guide being pivotally movable, about a vertical axis, between first and second positions with respect to said second support wall and said second guide recess;

said second can stop, when said second guide is in said first position, extending into said can passageway so as to be in the path of a can passing through said can passageway;

said second can stop, when said second guide is in said second position, being retracted into said second guide recess to permit a can to pass thereby;

said second support wall having vertically spaced-apart first and second spring openings, having inner and outer ends, formed therein which extend through said second support wall;

said inner ends of said first and second spring openings in said second support wall communicating with said second guide recess of said second support wall;

an elongated first coil spring having an inner end and an outer end;

an elongated second coil spring, having an inner end and an outer end;

said first and second coil springs being positioned in said first and second spring openings in said second support wall respectively whereby said outer ends of said first and second coil springs are positioned outwardly of said outer side of said second support wall and whereby said inner ends of said first and second coil springs are in engagement with said second guide;

a spring retainer plate positioned at said outer side of said second support wall which is in engagement with said outer ends of said first and second coil springs;

a first bolt extending through said second support wall and which is threadably secured to one of said internally threaded bolt openings in said support member of said second support wall; and a second bolt extending inwardly through said second support wall and which is threadably secured to the other internally threaded bolt opening in said support member of said second support wall.

3. In combination:

an apparatus for applying a can carrier to the upper ends of a plurality of cans as the cans pass therethrough;

said apparatus including a can passageway which is defined by horizontally spaced-apart and vertically disposed first and second support walls with said can passageway having a forward can inlet end and a rearward can outlet end;

said first support wall having an upper end, a lower end, a rearward end, a forward end, an inner side and an outer side;

a first guide recess formed in said inner side of said first support wall;

a first guide, having inner and outer sides, positioned in said first guide recess;

said first guide having a forward end and a rearward end;

said first guide, having a can stop extending outwardly from said outer side of said first guide;

said first guide being pivotally secured to said first support wall, about a vertical axis, forwardly of said rearward end of said first guide;

said first guide being pivotally movable, with respect to said first guide recess, between a first position and a second position;

said can stop of said first guide being positioned in said can passageway so as to be in the path of a can moving rearwardly in said can passageway when said first guide is in said first position;

said can stop of said first guide being positioned in said first guide recess when said first guide is in said second position to permit a can to pass by said first guide;

a spring operatively connected to said first guide which yieldably maintains said first guide in said first position;

a second guide recess formed in said inner side of said second support wall;

a second guide, having inner and outer sides, positioned in said second guide recess;

said second guide having a forward end and a rearward end;

said second guide, having a can stop extending outwardly from said outer side of said second guide;

said second guide being pivotally secured to said second support wall, about a vertical axis, forwardly of said rearward end of said second guide;

said second guide being pivotally movable, with respect to said second guide recess, between a first position and a second position;

said can stop of said second guide being positioned in said can passageway so as to be in the path of a can moving rearwardly in said can passageway when said second guide is in said first position;

said can stop of said second guide being positioned in said second guide recess when said second guide is in said second position to permit a can to pass by said second guide; and a spring operatively connected to said second guide which yieldably maintains said second guide in said first position.

* * * * *